US005239949A

United States Patent [19]

Elsbett et al.

[11] Patent Number: 5,239,949

[45] Date of Patent: Aug. 31, 1993

[54] COOLING JACKET AND THERMAL INSULATION FOR AN INTERNAL-COMBUSTION ENGINE

[76] Inventors: Ludwig Elsbett; Günter Elsbett; Klaus Elsbett, all of Industriestrasse 14, D-8543 Hilpoltstein, Fed. Rep. of Germany

[21] Appl. No.: 646,782

[22] PCT Filed: Jul. 28, 1989

[86] PCT No.: PCT/DE89/00496

§ 371 Date: Jan. 29, 1991

§ 102(e) Date: Jan. 29, 1991

[87] PCT Pub. No.: WO90/01632

PCT Pub. Date: Feb. 22, 1990

[30] Foreign Application Priority Data

Jul. 29, 1988 [DE] Fed. Rep. of Germany ..... 3825961

[51] Int. Cl.[5] ..... F02F 1/10

[52] U.S. Cl. ..... 123/41.72; 123/41.35; 123/41.42; 123/41.81

[58] Field of Search ..... 123/41.42, 41.72, 41.74, 123/41.81, 41.83, 41.84, 193.2, 41.35, 193.5

[56] References Cited

U.S. PATENT DOCUMENTS

| | | | |
|---|---|---|---|
| 1,413,372 | 4/1922 | Andres | 123/41.81 |
| 2,500,085 | 3/1950 | Milliken | 123/193.1 |
| 2,736,300 | 2/1956 | Flynn | 123/41.31 |
| 3,882,842 | 5/1975 | Bailey et al. | 123/41.84 |
| 4,530,314 | 7/1985 | Feichtinger | 123/41.74 |
| 4,542,719 | 9/1985 | Wilkinson | 123/41.35 |
| 4,729,347 | 3/1988 | Schmitz | 123/41.74 |
| 4,796,572 | 1/1989 | Heydrich | 123/41.42 |
| 4,867,119 | 9/1989 | Cooper et al. | 123/41.35 |
| 4,895,111 | 1/1990 | Elsbett | 123/41.35 |
| 4,926,801 | 5/1990 | Eisenberg et al. | 123/193.2 |

FOREIGN PATENT DOCUMENTS

| | | | |
|---|---|---|---|
| 1944312 | 4/1970 | Fed. Rep. of Germany . | |
| 133985 | 1/1979 | Fed. Rep. of Germany | 123/41.81 |
| 3134771 | 3/1983 | Fed. Rep. of Germany . | |
| 3314543 | 10/1984 | Fed. Rep. of Germany . | |
| 3613099 | 10/1987 | Fed. Rep. of Germany . | |
| 3633513 | 4/1988 | Fed. Rep. of Germany . | |
| 2069046 | 8/1981 | United Kingdom | 123/41.84 |
| 2143899 | 2/1985 | United Kingdom . | |

*Primary Examiner*—Noah P. Kamen
*Attorney, Agent, or Firm*—Peter K. Kontler

[57] ABSTRACT

An internal combustion comprises a cooling circuit of the cylinder heat and cylinder in the region of the upper dead center of the piston and cooling solely by oil injection into the cylinder in the lower region of the cylinder. The cooling circuit consists not or built-in-cooling channels but a separate component in the form of a jacket which together the cylinder and possibly the cylinder head forms the corresponding cooling chambers. To unify the thermal characteristics of the cylinder, a thermal insulation which may serve at the same time as acoustic insulation, is arranged in the lower part of the cylinder.

9 Claims, 1 Drawing Sheet

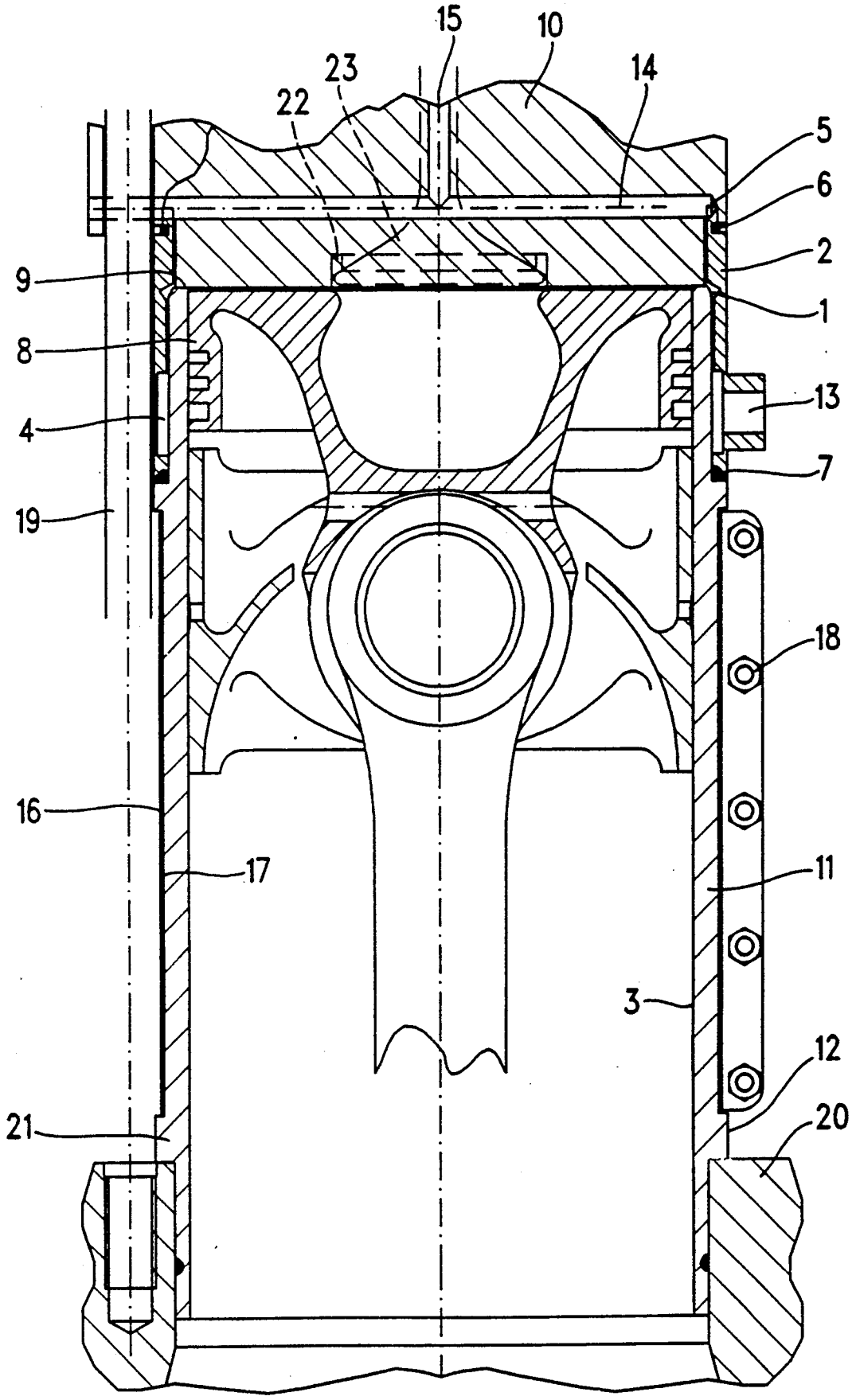
15
10
23
22
14
5
6
2
9
1
8
13
4
7
19
18
16
17
11
3
12
21
20

COOLING JACKET AND THERMAL INSULATION FOR AN INTERNAL-COMBUSTION ENGINE

BACKGROUND OF THE INVENTION

An internal-combustion engine is known from the German patent 33 14 543 and has a cooling circuit which cools the cylinder head and the area of the cylinder at top dead center of the piston. Cooling and heating are in balance. The cooling circuit is here incorporated in the cylinder and cylinder head or is provided in the cast components. Consequently, manufacture of these components is labor-intensive and their cost is high. U.S. Pat. No. 4,729,347 discloses a combustion engine in which the lower regions of the cylinders are air-cooled and the cylinder heads are fluid-cooled by a complicated array of channels. Since the material of a cylinder head is welded to the cylinder, cooling of this area cannot be accomplished via the cooling channels normally built into the cylinder wall. Instead, an extra annular channel must be formed around the cylinder by means of a separate casing.

SUMMARY OF THE INVENTION

The object of the invention is to improve an internal-combustion engine in such a manner that it is simple to manufacture and can be compact, that the individual components can be produced easily and that uniform cooling can be obtained.

This is achieved by eliminating the cooling channels in the cylinder, and forming the cylinder head from a casting which was cast without a core serving to define a space for circulating cooling fluid. An uncomplicated component is used to form the cooling chamber for the cylinder in the region of top dead center of the piston. This component is also capable of forming the cooling circuit in the cylinder head. The component is a jacket which is placed over the cylinder and can overlap the cylinder head.

To maintain the thermal balance of the cylinder, particularly in the case of a free-standing cylinder, a thermally and acoustically insulating sleeve is placed on the bottom portion of the cylinder so that external thermal influences do not affect the cylinder. The acoustical insulating action which can be especially desirable for free-standing cylinders.

The internal-combustion engine of the invention has the following advantages: The cylinder and cylinder head can be manufactured as simple components without additional processing. In the case of cast components, these can be produced without a core as far as the cooling circuit is concerned. Cooling is assured in the critical areas of the valve seat and the upper reversal point of the piston. Due to the smaller cross section of the cooling circuit chamber, which can be as little as one-tenth of that for cast components, the cooling efficiency can be increased since a higher rate of circulation of the cooling agent is achieved and less cooling agent must be circulated.

By virtue of the smaller cooling circuit cross section obtained with the jacket, closer placement of the cylinders to one another can be achieved. This is important for internal-combustion engines having many cylinders and also allows the cylinder bores to be enlarged for the same size internal-combustion engine.

As a cooling circuit component, the jacket is not mechanically loaded inasmuch as the screws for the head conduct no forces into the jacket. The jacket assumes the temperature of the cooling agent at all locations and, as a result, the jacket can be sealed without difficulty.

The invention can be used in motors where the lubricating oil simultaneously serves as a cooling agent. In this case, very simple circuits are obtained. Mixing of the oils in the head is not harmful and the same is true for head and oil chamber.

Aside from the acoustical damping achieved by the use of the thermally and acoustically insulating sleeve, thermal insulation of the lower portion of the cylinder is obtained for free-standing cylinders. When the external temperatures are low, the temperatures in the lower region of the cylinder can nevertheless reach those in the upper region of the cylinder. The cylinder need not be conically honed in order to establish a seal between the piston and the inner cylinder wall.

Due to the compact construction, the cooling jacket and insulating sleeve can lie within the boundary defined by the head screws without placing the head screws at a great distance from the cylinder. Thus, no bending forces are introduced into the head or the crank housing.

The cooling circuit chamber which accommodates the cooling fluid is defined by the readily installed and removed jacket whose one end is sealed at the head and whose other end is sealed at the cylinder. The chamber defined by the cylinder, head and jacket can be made annular by dressing the head plate and the upper, outer diameter of the cylinder. The jacket can overlap the cylinder and the head, can project into an annular groove in the head or can seat flush against the underside of the head. The jacket can be made of sheet material or can be a rotary machined component. The cooling circuit chamber which accommodates the cooling fluid can completely surround the enclosed portions of the head and cylinder.

The dimensions of the gap between the outer diameter of the cylinder and the inner diameter of the jacket can be used to control the uniformity of cooling and the rate of circulation of the cooling agent. The sealing locations in this construction can be placed in such a manner that they are neither thermally nor mechanically stressed.

The thermal and acoustic insulator at the lower portion of the cylinder can be a sleeve, a tubular component or a foamed mass.

BRIEF DESCRIPTION OF THE DRAWING

The single FIGURE is a fragmentary cross section through a combustion engine in the region around the cylinder barrel.

DESCRIPTION OF PREFERRED EMBODIMENTS

The cylinder barrel 11 is seated on the crank housing 20 via a collar 21 and is braced against the cylinder head 10 by means of the tie rod 19 which is here shown displaced.

The end of the cylinder barrel 11 facing the cylinder head 10 is completely surrounded, in the region of the sealing section 8 of the piston which prevents internal cooling of the cylinder barrel 11, by a lower portion of a cooling jacket 2. An upper portion of the jacket 2 surrounds the cylinder head 10 in the region of the head plate which is formed with the seat 22 for a valve 23. The cooling jacket 1, 2 bears against the cylinder head 10 via first sealing means 6 and against the cylinder barrel 11 via second sealing means 7. The cooling agent enters an annular groove 4 by means of the connection 13 and flows to an annular gap 1. The annular groove 4 has a greater flow cross section than the annular gap 1. From the collecting groove 5, the cooling agent flows to additional components of the cylinder head 10 to be cooled or through bores 14 and 15 to the radiator. The dimensioning of the annular gap results in uniform distribution of the cooling agent over the peripheries of the components and in a high flow rate.

A thermally and acoustically insulating sleeve 16 is mounted on the uncooled portion of the cylinder barrel 11 like a casing and is separated from the uncooled portion of the cylinder barrel 11 by an insulating intermediate layer 17. The insulating sleeve 16 may be fixed to the cylinder barrel 11 by screws 18 or may be freely seated on the cylinder barrel 11. It is also possible for the insulating sleeve 16 to be in the form of a length of material which is wound around the cylinder barrel 11 and secured.

The collar 21 of the cylinder barrel 11 has an outer diameter which exceeds the outer diameter of that portion of the cylinder barrel 11 surrounded by the jacket 2. The jacket 2 and sleeve 16 do not project beyond the collar 21, either in the region of the tie rod 19 or in the region of the neighboring cylinder barrel. The inner diameter 3 of the cylinder barrel 11 can accordingly exceed 88 percent of the center-to-center distance between cylinders. In the illustrated embodiment, the outer diamter of the jacket 2 equals the outer diameter of the collar 21.

We claim:

1. An internal combustion engine, particularly a high-powered internal combustion engine, comprising a cylinder having a wall which is free of channels for circulating cooling fluid; a head for said cylinder including a casting which was cast without a core serving to form a space for circulating cooling fluid; a removable jacket circumscribing at least one portion of said wall, said jacket including an annular ring and having a first end adjacent to said head and a second end adjacent to said wall, and said jacket cooperating with at least one of said wall and said head to define a chamber for circulating cooling fluid, said one portion of said wall bordering said head and said wall having another portion remote from said head; and a liner for said other portion of said wall.

2. The engine of claim 1, wherein said liner is acoustically damping.

3. The engine of claim 1, wherein said liner is thermally insulating.

4. The engine of claim 1, wherein said liner is acoustically damping and thermally insulating.

5. The engine of claim 1, wherein said liner comprises a tube free of direct connection to said wall.

6. An internal combustion engine, particularly a high-powered internal combustion engine, comprising a cylinder having a wall which is free of channels for circulating cooling fluid; a head for said cylinder including a casting which was cast without a core serving to form a space for circulating cooling fluid; and a removable jacket circumscribing at least one portion of said wall, said jacket having a first end adjacent to said head and a second end adjacent to said wall, and said jacket cooperating with at least one of said wall and said head to define a chamber for circulating cooling fluid, said chamber having a first section nearer said first end and a second section nearer said second end, and said second section having a greater flow cross section than said first section.

7. An internal combustion engine, particularly a high-powered internal combustion engine, comprising a cylinder having a wall which is free of channels for circulating cooling fluid; a head for said cylinder including a casting which was cast without a core serving to form a space for circulating cooling fluid; a removable jacket circumscribing at least one portion of said wall, said jacket having a first end adjacent to said had and a second end adjacent to said wall, and said jacket cooperating with at least one of said wall and said head to define a chamber for circulating cooling fluid, said one portion of said wall bordering said had, and said wall having another portion remote from said head; and a liner for said other portion of said wall, said liner comprising a length of material which is wound around said wall an secured thereto.

8. An internal combustion engine, particularly a high-powered internal combustion engine, comprising a cylinder having a wall which is free of channels for circulating cooling fluid; a head for said cylinder including a casting which was cast without a core serving to form a space for circulating cooling fluid; a removable jacket circumscribing at least one portion of said wall, said jacket having a first end adjacent to said head and a second end adjacent to said wall, and said jacket cooperating with at least one of said wall and said head to define a chamber for circulating cooling fluid, said one portion of said wall bordering said head, and said wall having another portion remote from said head; and a liner for said other portion of said wall, said liner being fixed to said wall.

9. A internal combustion engine, particularly a high-powered internal combustion engine, comprising a cylinder having a wall which is free of channels for circulating cooling fluid; a head on said cylinder including a casting which was cast without a core serving to form a space for circulating cooling fluid, said head being seated substantially flush on said wall; and a removable jacket circumscribing at least one portion of said wall, said jacket including an annular ring and having a first end adjacent to said head and a second end adjacent to said wall, and said jacket cooperating with at least one of said wall and said head to define a chamber for circulating cooling fluid.

* * * * *